US005532579A

United States Patent [19]

Park

[11] Patent Number: 5,532,579

[45] Date of Patent: Jul. 2, 1996

[54] TEMPERATURE STABILIZED LOW REFERENCE VOLTAGE GENERATOR

[75] Inventor: Seung K. Park, Seoul, Rep. of Korea

[73] Assignee: Goldstar Electron Co., Ltd., Choongchungbook-do, Rep. of Korea

[21] Appl. No.: 271,816

[22] Filed: Jul. 7, 1994

[30] Foreign Application Priority Data

Feb. 7, 1994 [KR] Rep. of Korea ..... 2235/1994

[51] Int. Cl.[6] ..... G05F 3/16

[52] U.S. Cl. ..... 323/314; 323/316; 323/907

[58] Field of Search ..... 323/313, 314, 323/315, 316, 907

[56] References Cited

U.S. PATENT DOCUMENTS 4,396,883 8/1983 Holloway et al. ..... 323/313
4,472,675 9/1984 Shinomiya ..... 323/314
4,525,663 6/1985 Henry ..... 323/315
5,325,045 6/1994 Sundby ..... 323/316

FOREIGN PATENT DOCUMENTS 933927 2/1994 Rep. of Korea .

*Primary Examiner*—Jeffrey I. Sterrett
*Attorney, Agent, or Firm*—Lowe, Price, LeBlanc & Becker

[57] ABSTRACT

A reference voltage generator includes a current mirror circuit connected to a power supply voltage and having a plurality of transistors which are coupled in parallel to the power supply voltage, a reference current circuit connected between the current mirror circuit and a ground for generating a reference current in accordance with an differential operation, a feedback circuit for applying the reference current to the current mirror circuit, and a constant voltage circuit having an operational amplifier whose input terminal is connected to the current mirror circuit for generating the reference voltage.

5 Claims, 2 Drawing Sheets

TEMPERATURE STABILIZED LOW REFERENCE VOLTAGE GENERATOR

BACKGROUND OF THE INVENTION

1. Field of the Invention

The present invention relates generally to voltage regulation, particularly to a reference voltage generator for restraining the fluctuation of a reference voltage caused by temperature variations in an integrated circuit utilizing a low power supply voltage.

2. Description of the Prior Art

It is well known in the art that various integrated circuits utilize a reference voltage generator for the purpose of providing a reference voltage to circuit elements which detect or amplify an information signal. Demands made upon the reference voltage are basically that it remains stable even under circumstances of temperature variation and varied power supply voltages. Specially, in low power integrated circuits for reduced power dissipation, the reliability of the reference voltage becomes even more important than before.

FIG. 1 shows a conventional reference voltage generator which is disclosed in Korean Patent Publication No. 93-3927, published on May 15, 1993 (corresponding to Korean Patent Application No. 90-11946 filed by TOSIHBA CO. on Aug. 3, 1990). In the circuit of FIG. 1, the base and collector of an NPN bipolar transistor Q3 are coupled to the base of a PNP bipolar transistor Q2, and the emitter of transistor Q2 is connected to ground through a resistor R2. The collector of transistor Q2 is connected to the emitter of an NPN bipolar transistor Q1 through a resistor R1, and the emitter of transistor Q1 is also connected to the collector of transistor Q3 through a resistor R3. The base of transistor Q1 is coupled to a power supply voltage Vcc through a resistor R4 and is also coupled directly to the collectors of an NPN bipolar transistor Q4 and a PNP bipolar Q5, collector of transistor Q1 is connected to the power supply voltage Vcc. The base and emitter of transistor Q4 are coupled to the collector of transistor Q2 and to ground, respectively. The emitter of transistor Q5 is connected to ground through a resistor R5, and a battery VBB is connected between the base of transistor Q5 and ground.

The voltage difference ΔVBE between the base and emitter of transistor Q2 (or of transistor Q3) across the resistor R2 is defined below:

$$\begin{aligned} \Delta VBE &= VBE3 - VBE2 \\ &= VT\ln(I3/I2) \\ &= VT\ln(R1/R2) \\ &= R2\,I2 \end{aligned} \quad (1)$$

where

VBE2=voltage between the base and emitter of transistor Q2;

VBE3=voltage between the base and emitter of transistor Q3;

I2=collector current of transistor Q2; and

I3=collector current of transistor Q3.

Thus, reference voltage Vref appearing at the collector of transistor Q4 may be given by:

$$Vref=(R1/R2)\Delta VBE+\Delta VBE4=(R1/R2)ln(R1/R3)VT+\Delta VBE4 \quad (2)$$

where

ΔVBE4=voltage difference between the base and emitter of transistor Q4; and

VT=volt-equivalent of temperature.

Since the VT has a positive factor proportional to temperature while VBE has a negative factor, the reference voltage Vref having a temperature coefficient of zero may be generated as a constant voltage by means of adjusting the resistance values of R1 to R3.

Although the conventional reference voltage generator as shown in FIG. 1 is able to provide a constant reference voltage, the conventional circuit can not be adapted to a system employing a power supply voltage of 1.5 V or less supplied by one battery or less because the constant voltage having a zero temperature coefficient appears at a voltage level of 1.2 V through 1.3 V and such range of the voltage level can not be provided until the power supply voltage is at least more than 2 V, taking into account the voltage drop between the base and emitter of transistor Q1. For meeting the demands of the lower power operation of integrated circuits such as memory devices, due to these limitations, the conventional reference voltage generator may not be capable of providing reliable operation of the low power device.

SUMMARY OF THE INVENTION

Therefore, it is an object of the present invention to provide a reference voltage generator capable of generating a constant reference voltage free from variations due to temperature change even in an integrated circuit which employs a lowered power supply voltage of less than 1.2 V.

It is another object of the present invention to provide a reference voltage generator which is suitable liar an integrated circuit employing a lowered power supply voltage.

Briefly described the present invention relates to a reference voltage generator including a current mirror circuit connected to a power supply voltage and having a plurality of transistors which are coupled in parallel from said power supply voltage, a reference current circuit connected between the current mirror circuit and ground for generating a reference current in accordance with a differential operation, a feedback circuit for applying the reference current to the current mirror circuit, and a constant voltage circuit having an operational amplifier whose input terminal is connected to the current mirror circuit and generating the reference voltage.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
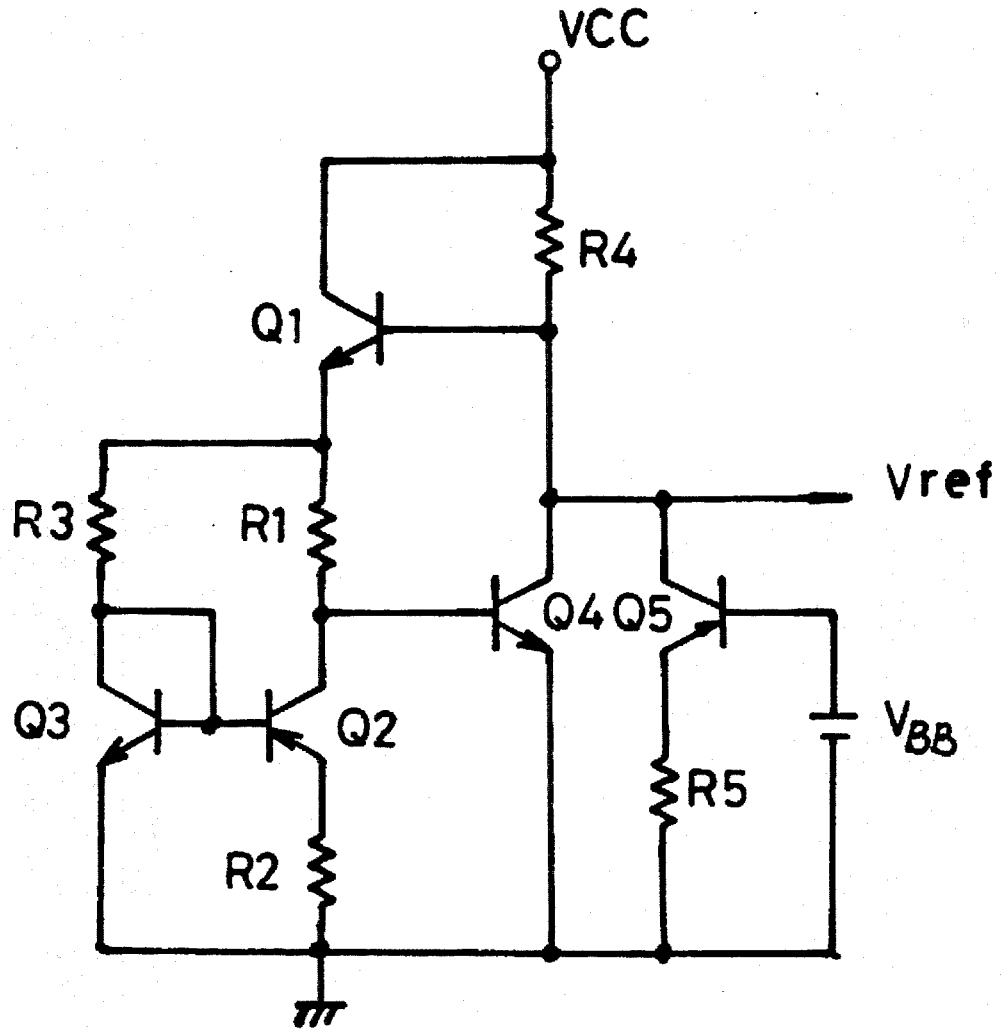
FIG. 1 CONVENTIONAL ART
FIG. 1 is a circuit diagram of a conventional reference voltage generator.
Figure 2:
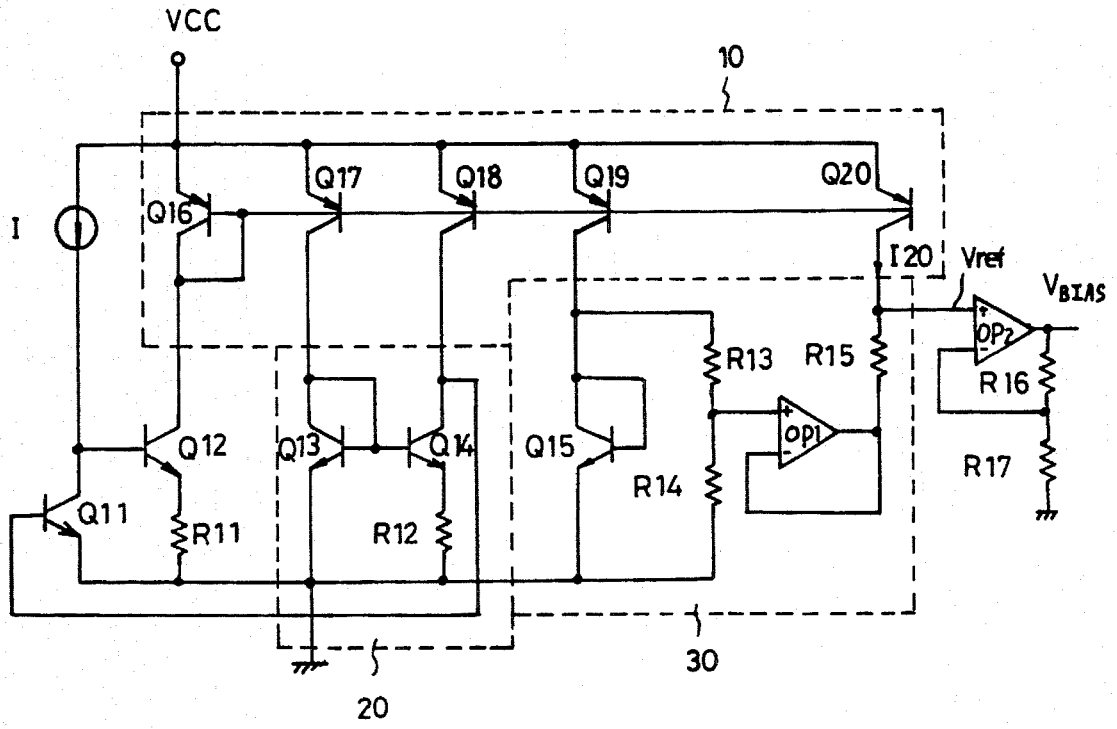
FIG. 2 is a circuit diagram of a reference voltage generator according to an embodiment of the present invention.

Referring now in detail to the drawing for the purpose of illustrating preferred embodiments of the present invention, the reference voltage generator according to the present invention as shown in FIG. 2 includes a current mirror circuit 10 having a plurality of PNP bipolar transistors Q16, Q17, Q18, Q19 and Q20 the bases and emitters of which are coupled in common to a power supply voltage Vcc and the bases of which are commonly coupled with each other and to the collector of transistor Q16. The reference voltage generator also includes a reference current circuit 20 having NPN bipolar transistors Q13 and Q14 which form a differential operating configuration, and also includes a constant voltage circuit 30 having an operational amplifier OP1 to generate a reference voltage Vref and an NPN bipolar transistor Q15. The reference voltage generator further includes an operational amplifier OP2 for receiving an output signal of the operational amplifier OP1 and generating a bias voltage VBIAS for internal use.

In the current mirror circuit 10, the emitters of the transistors Q16 to Q20 are also connected to a collector of an NPN bipolar transistor Q11 and to the base of an NPN bipolar transistor Q12, through an independent current source I. The base and collector of transistor Q15 arc coupled together. The emitter of transistor Q12 is connected to ground through a resistor R11. Transistors Q11 and Q12 arc provided to transfer the current generated from the reference current circuit 20 so as to maintain a stable operation of the current mirror circuit 10.

In the reference current circuit 20, a collector of the transistor Q13, which is commonly connected to basic electrodes of transistors Q13 and Q14 and which has its emitter grounded, is coupled to the collector of transistor Q17. The collector of transistor Q14 is coupled to both the collector of transistor Q18 and the base of transistor Q11. The emitter of transistor Q14 is connected to ground through a resistor R12.

The noninverting input terminal(+) of the operational amplifier OP1 is coupled to the junction of two voltage dividing resistors R13 and R14, with the other end of resistor R13 being connected to the collector of transistor Q19 and with the other end of resistor R14 being grounded. The basic and collector of transistor Q15 arc coupled to the collector of transistor Q19, with the emitter of transistor Q15 being grounded. The operational amplifier OP1 has the configuration of voltage-shunt feedback in which the inverting input terminal(−) is coupled to the output terminal, and the output terminal is connected to collector of transistor Q20 through a resistor R15.

The noninverting input terminal(+) of operational amplifier OP2 is connected to a node between the collector of transistor Q20 and the resistor R15, and voltage dividing resistors R16 anti R17 are connected in series between the output terminal of operational amplifier OP2 and ground. The inverting input terminal(−) of operational amplifier OP2 is connected to a node between the resistors R16 and R17. The resistor R15 connected to the noninverting input terminal(+) of operational amplifier OP2 may reduce the input impedance of the operational amplifier OP2.

Hereinafter, the operation of the reference voltage generator shown in FIG. 2 according to a preferred embodiment of the invention will be explained. Since the same current flowing from the collectors of the transistors Q16 through Q20 makes the collector currents of transistors Q13 and Q14 be the same with each other, the base-emitter voltage VBE13 (or VBE14) of transistor Q13 (or transistor Q14) may be given $$\begin{aligned} VBE13 &= VT\ln(I14/I13) \\ &= VBE14 + I14\,R12 \\ &= VT\ln(I13/(Is\,n)) + I14\,R12 \end{aligned} \quad (3)$$

where

VBE13=voltage between the base and emitter of transistor Q13;

VBE14=voltage between the base and emitter of transistor Q14;

I13=collector current of transistor Q13;

I14=collector current of transistor Q14;

Is=reverse saturation current; and n=ratio of the emitter size between the transistors Q13 and Q14.

Since both the currents I13 and I14 are substantially anti nearly the same, the equation (3) may be rewritten as $$I14\ R12 = VT\ln(n)$$

then $$I14 = (1/R12)VT\ ln(n) \quad (4)$$

It should be noted that in order to stabilize the current I14 a feed-back loop conducts the collector current of transistor Q14 to transistor Q16 of the current mirror circuit 10 through the transistors Q11 and Q12.

In the constant voltage circuit 30, the operational amplifier OP1 compares that voltage which is supplied by the collector of the transistor Q19 of the current mirror circuit 10 and divided by the resistance factor of R14/(R13+R14), with the voltage present at its inverting input terminal that is coupled to its output terminal, resulting in the reference voltage Vref which is given by:

$$Vref = R14/(R13+R14)VBE + R15\ I20 = R14/(R13+R14)VBE + (R15/R12)VT\ In(n) \quad (5)$$

The operational amplifier OP2 compares the output voltage of the operational amplifier OP1 through the resistor R15 with the divided voltage established by the resistance factor of R17/(R16+R17), and generates the bias voltage VBIAS. In equation (5), the first component includes negative factors proportional to the temperature variation due to VBE while the second component has positive factors due to VT. In addition to the complementary proportional factors countering against voltage variation due to temperature variation, the reference voltage Vref expressed in equation (5) includes the factor relating to the emitter size ratio n between the transistors Q13 and Q14, as well as the resistance values. Thus, it can be known that though provided in a system employing a low power supply voltage of less than 1.2 V it is possible to obtain a stable and reliable reference voltage because of optimal adjustments with the factors VBE, R12 to R15, and n.

As described hereinabove, the reference voltage generator according to the present invention is useful for a system employing a low power supply voltage in that reference voltage can be enhanced up to a sufficient level and can be stabilized for the situation of temperature variation. Such a reference voltage generator enables systems such as an integrated circuit with low power supply voltage of less than 1.2 V to operate in a stable voltage driving environment.

While the embodiment has been described in terms of a reference voltage generator including bipolar transistor units, it is to be understood that the present invention is not limited to those precise embodiments, and various changes and modifications can be effected therein by those skilled in the art without departing from the scope and spirit of the accompanying claims. As an example, the circuit will also perform equally well with complementary MOSFET (metal-oxide-semiconductor filed effect transistor) units in which the variable factors VBE and n become instead the gate-to-source voltage anti channel size ratio, respectively.

What is claimed is:

1. A reference voltage generator comprising:

a current mirror circuit for being connected to a power supply voltage and having a plurality of transistors which are coupled in parallel to said power supply voltage;

a reference current circuit, connected between said current mirror circuit and a ground, for generating a reference current in accordance with a differential operation;

feedback means for applying said reference current to said current mirror circuit; and a constant voltage circuit having a first operational amplifier, with an input terminal of said first operational amplifier being connected to said current mirror circuit for generating said reference voltage.

2. A reference voltage generator according to claim 1, wherein said reference current circuit includes a pair of transistors the respective control electrodes of which are coupled in common to an output of said current mirror circuit, and wherein current paths of said pair of transistors are connected in parallel between said current mirror circuit and said ground.

3. A reference voltage generator according to claim 1, wherein said feedback means includes a transistor circuit having a current path connected between said current mirror circuit and said ground.

4. A reference voltage generator according to claim 1, wherein said constant voltage circuit includes a pair of resistors connected in series to an output of said current mirror circuit, and wherein said input terminal of said first operational amplifier is coupled to a junction node between said resistors.

5. A reference voltage generator according to claim 1, further comprising a second operational amplifier for receiving said reference voltage and generating a bias voltage.

* * * * *